United States Patent [19]

Sakashita

[11] Patent Number: 4,919,032

[45] Date of Patent: Apr. 24, 1990

[54] ELECTRONIC INSTRUMENT WITH A PITCH DATA DELAY FUNCTION

[75] Inventor: Shigeo Sakashita, Tokyo, Japan

[73] Assignee: Casio Computer Co., Ltd., Tokyo, Japan

[21] Appl. No.: 287,405

[22] Filed: Dec. 20, 1988

[30] Foreign Application Priority Data

Dec. 28, 1987 [JP] Japan ..... 62-200157[U]
Aug. 19, 1988 [JP] Japan ..... 63-108343[U]
Aug. 19, 1988 [JP] Japan ..... 63-204818

[51] Int. Cl.[5] ..... G10H 1/18; G10H 1/42; G10H 5/00

[52] U.S. Cl. ..... 84/653; 84/668; 84/742

[58] Field of Search ..... 84/1.04–1.16, 84/653, 668, 723, 742

[56] References Cited

U.S. PATENT DOCUMENTS 3,767,833 10/1973 Noble et al. .
3,938,419 2/1976 De Rosa ..... 84/1.14
4,418,599 12/1983 Raskin ..... 84/1.09 X
4,757,737 7/1988 Conti ..... 84/1.12

*Primary Examiner*—Stanley J. Witkowski
*Attorney, Agent, or Firm*—Frishauf, Holtz, Goodman & Woodward

[57] ABSTRACT

A pitch of a musical tone to be generated based on a breath sense signal detected by a breath sensor is set by a pitch setting operation of a pitch setting section. When the pitch setting operation is changed during generation of the musical tone based on the breath sense signal, pitch data corresponding to a pitch newly set by the change in the pitch setting operation is output upon elapse of a predetermined time from the timing of the change. The pitch of a musical tone being generated is altered to the pitch according to the new pitch data upon elapse of the predetermined time.

11 Claims, 7 Drawing Sheets

ELECTRONIC INSTRUMENT WITH A PITCH DATA DELAY FUNCTION

BACKGROUND OF THE INVENTION

1. Field of the Invention

The present invention relates to an electronic wind instrument which generates a musical tone with a pitch in response to the breath manipulation of a player, and, more particularly, to an electronic wind instrument with a pitch data delay function that prevents a musical tone with an undesired pitch being generated during fingering operation.

2. Description of the Related Art

Electronic wind instruments generally detect the breath manipulation of a player, as an electric signal, by means of a breath sensor provided at the mouthpiece and generate a musical tone with a pitch specified by a plurality of pitch-setting switches provided on the musical instrument body, in accordance with the detected electric signal.

Unlike electronic keyboard instruments, the electronic wind instruments of this type specify one pitch by a combined operation of pitch-setting switches. When one pitch is altered to another, therefore, it is necessary to perform simultaneous OFF operation of a plurality of pitch-setting switches that have been operated in combination in advance and immediately perform simultaneous ON operation of another group or combination of pitch-setting switches. This operation requires skills and causes even skilled players to have a period in which the proper fingering operation is not performed, thus generating a musical tone with the undesired, improper pitch during that transient instance.

A solution to this problem has recently been disclosed in U.S. Pat. No. 3,767,833. The disclosed electronic wind instrument is provided with a tone stopping circuit which temporarily stops tone generation during octave shifting in order to prevent a musical tone with the undesired pitch being generated during this octave shifting. With this instrument, however, tone generation is stopped even temporarily during a musical performance and the music played would not have the effect of natural and smooth volume change.

Further, there would be a significant difference in level of the fingering operation technique between novice and skilled players, and the above problem cannot be solved simply for all the players.

Furthermore, with the use of the electronic wind instruments of this type, an octave changing switch is operated to increase or reduce the pitch set by the pitch-setting switches by units of octave. As the octave-changing operation is normally performed by a player's thumb, this operation is particularly difficult as compared with the pitch altering operation by the pitch-setting switches. It is therefore difficult to perform the octave changing operation in synchronism with the fingering operation of the pitch-setting switches. In this case, there also arises a problem that a musical tone with the undesired pitch is generated while the pitch specified by the pitch-setting switches is altered to another pitch of a predetermined octave higher or lower, by operating the octave-changing switch.

SUMMARY OF THE INVENTION

Accordingly, it is an object of this invention to provide an electronic wind instrument which can prevent a musical tone with the undesired pitch from being generated even if there occurs some variation in fingering operation of a plurality of pitch-setting means that is performed to alter the presently-specified pitch to another one.

It is another object of this invention to provide an electronic wind instrument which can generate a musical tone with the pitch newly set by a change in fingering operation upon elapse of a time corresponding to the level of the fingering operation technique of a player.

It is a further object of this invention to provide an electronic wind instrument which can prevent a musical tone with the undesired pitch from being generated even if the operation of the octave-changing means is not in synchronism with the fingering operation of the pitch-setting means.

It is a still another object of this invention to provide an electronic wind instrument which can permit a player to freely set a delay time proper for the operation of the octave-changing means that is more difficult than the fingering operation of the pitch-setting means.

To achieve the above objects, according to this invention, every time a change occurs in the pitch setting operation of a plurality of pitch-setting means, the point of that change is detected by change point detecting means, and pitch data newly set by the change in pitch setting operation is produced by musical tone control means upon elapse of a predetermined time from the point of change, whereby a musical tone is generated with the pitch according to this new pitch data. Even when the operational transients of a plurality of combined pitch-setting means do not occur simultaneously and the pitch setting operation is executed with some time delay from one pitch-setting means to another, pitch data corresponding to the pitch newly set by the change in pitch setting operation can be produced upon elapse of a predetermined time from the point of change in the operation of the combined pitch-setting means. It is therefore possible to prevent a musical tone with the undesired pitch from being generated even temporarily. Further, the electronic wind instrument according to this invention is not designed to generate a musical tone with a new pitch after temporary tone off, so that the pitch can be altered alone without temporarily stopping the tone generation.

In addition, according to this invention, a plurality of pitch-setting means are constituted by a plurality of first pitch-setting means and at least one second pitch-setting means, and the first and second times for new pitch data to be generated from the points at which the pitch setting operations of the first and second pitch-setting means are changed, can be freely and variably set. Accordingly, the first and second times can be freely set in accordance with the technical level of operating the first and second pitch-setting means.

Furthermore, according to this invention, since the second time is set longer than the first time, the pitch setting operation of the first pitch-setting means can be performed with a quick tempo, whereas the second pitch-setting means can be operated with a slow tempo.

DETAILED DESCRIPTION OF THE PREFERRED EMBODIMENTS

Preferred embodiments of this invention will be described below with reference to the accompanying drawings.

FIRST EMBODIMENT

The first embodiment of this invention will be described below.

Arrangement of the First Embodiment

Figures 1A, 1B, 1C:
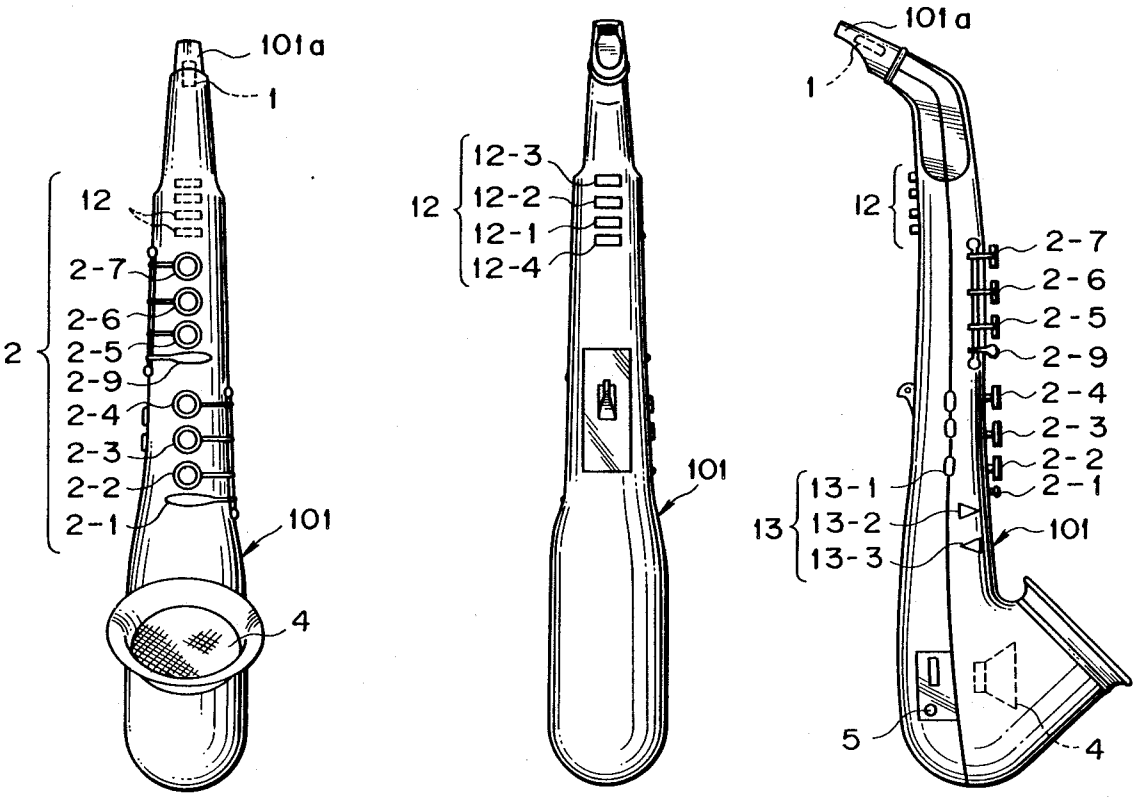
FIGS. 1A through 1C are respectively front, back and left side views illustrating the outline of an electronic wind instrument according to this invention.

FIGS. 1A through 1C are respectively front, back and left side views illustrating the outline of the electronic wind instrument according to the first embodiment of this invention.

A wind instrument body 101 is provided with a breath sensor 1 for detecting the strength, or the amount, of breath applied to a mouthpiece 101*a*, pitch-setting switches 2 (2-1 to 2-8) for setting the pitch of a musical tone to be generated, timbre/effect changing switches 3, a speaker 4 and a power switch 5.

At the back of wind instrument body 101 are provided octave-changing switches 12 for altering a pitch set by the fingering operation of pitch-setting switches 2 by units of octave and setting it. The octave-changing switches 12 include a normal setting switch 12-1 for setting the pitch set by pitch-setting switches 2, a 1 octave-up switch 12-2 for altering and setting the pitch set by pitch-setting switches 2 to a pitch one octave higher, a 2 octave-up switch 12-3 for altering and setting the pitch set by pitch-setting switches 2 to a pitch two octaves higher, and a 1 octave-down switch 12-4 for altering and setting the pitch set by pitch-setting switches 2 to a pitch one octave lower.

At the side of wind instrument body 101 are provided delay time setting switches 13 that constitute delay time variable setting means. The delay time setting switches 13 include a delay time setting mode selecting switch 13-1 for selecting which one of the first and second delay times should be variably set, and UP switch 13-2 and DOWN switch 13-3 for independently changing the first and second delay times by a predetermined time unit; the first delay time is a time set for delaying the output of pitch data corresponding to a pitch newly set by a change, when occurred, in the fingering operation of pitch-setting switches 2, by a predetermined time from the point of the change, and the second delay time is a time set for delaying the output of pitch data corresponding to a pitch newly set by a change, when occurred, in the changing operation of octave-changing switches 12, by a predetermined time from the point of the change.

Figure 2:
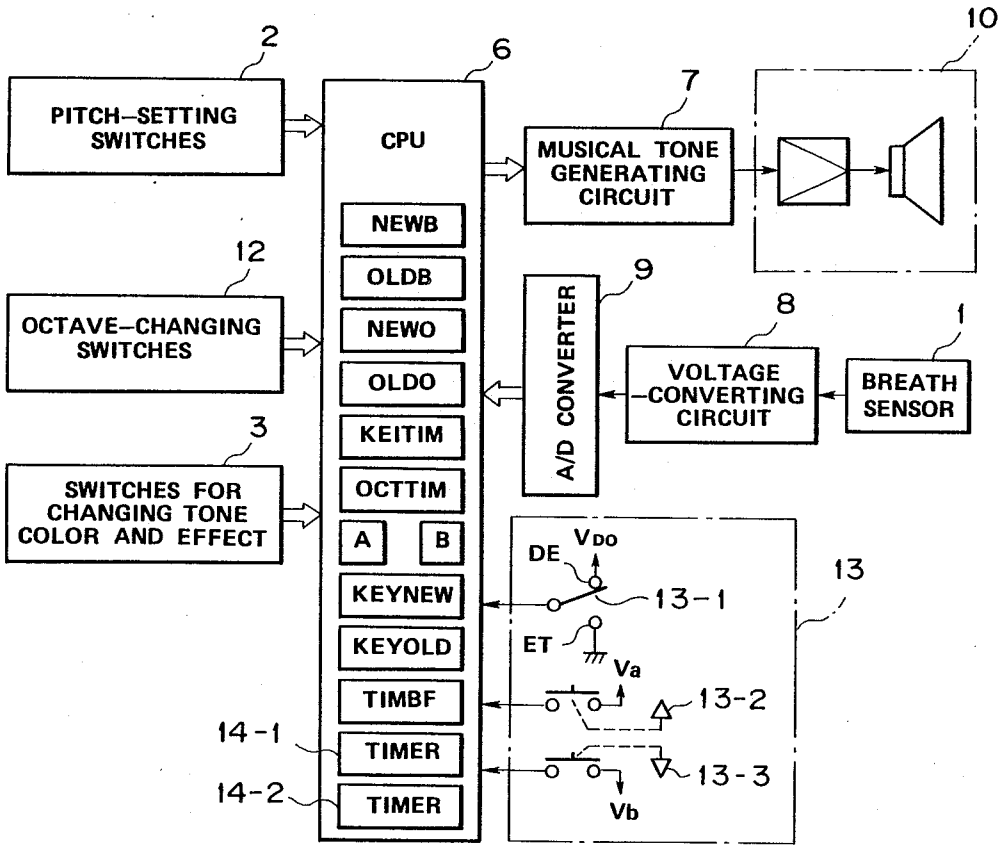
FIG. 2 is a diagram illustrating the general arrangement of an electric circuit used in this electronic wind instrument.

FIG. 2 is a diagram illustrating the general structure of an electric circuit in wind instrument body 101 as shown in FIGS. 1A through 1C.

A CPU (central processing unit) 6 constituted by a microprocessor performs the general control of the electric circuit of the electronic wind instrument and controls the generation and tone off of a musical tone from a musical tone generating circuit 7.

The first function of this CPU 6 is to receive pitch data from pitch-setting switches 2 that constitute the pitch-setting means and send the data to musical tone generating circuit 7.

The second function of CPU 6 is to receive digital breath data generated in accordance with breath data from breath sensor 1 that constitutes breath sensor means and send the digital breath data to musical tone generating circuit 7 as tone generation start data and tone control data concerning tone volume, timbre, etc. The digital breath data is acquired by converting the breath data into a corresponding voltage value in a voltage-converting circuit 8 and then converting the voltage value into digital data in an A/D converter 9.

The third function of CPU 6 is to receive pitch data from pitch-setting switches 2 and timbre/effect data selected by the operation of timbre/effect-changing switches 3 and send, to musical tone generating circuit 7 and a tone outputting device 10, a musical tone with a specific pitch and with specific timbre and effect set in accordance with the individual received.

The fourth function of CPU 6 is such that, when the fingering operation of at least one of pitch-setting switches 2 is altered during breath manipulation in order to alter the pitch of a musical tone to be generated, CPU 6 sends, to musical tone generating circuit 7, new pitch data corresponding to the pitch newly set by the altered fingering operation upon elapse of a predetermined first delay time from the point of the alteration based on an instruction from a timer 14-1. In this case, the first delay time can be freely set by a player, and this setting is executed in the following procedure.

First, delay time setting mode selecting switch 13-1 included in delay time setting switches 13 is operated so that switch 13-1 is coupled to a terminal DE applied with a predetermined voltage $V_{DD}$. This predetermined voltage $V_{DD}$ is then applied to CPU 6 through this switch 13-1. This selects the mode for variably setting the first delay time for pitch-setting switches 2. On the other hand, when switch 13-1 is coupled to a ground terminal ET, the ground potential is applied through this switch 13-1 to CPU 6, thus selecting the mode for variably setting the second delay time for octave-changing switches 12. With the delay time setting mode being set for either pitch-setting switches 2 or octave-changing switches 12, when UP switch 13-2 is turned ON, a voltage Va is applied to CPU 6 and the delay time is set longer by a predetermined time, e.g., 5 msec, upon every ON operation of this switch 13-2. When DOWN switch 13-3 is turned ON, however, a voltage Vb is applied to CPU 6 and the delay time is set shorter by a predetermined time, e.g., 5 msec, upon every ON operation of this switch 13-3. If UP switch 13-2 and DOWN switch 13-3 are simultaneously turned ON, the delay time is set at the middle value, for example, 20 msec.

The fifth function of CPU 6 is such that, when the ON/OFF status of at least one of octave-changing switches 12 is changed by the changing operation of that switch 12 in order to alter the pitch set by the fingering operation of pitch-setting switches 2 by units of octave, CPU 6 outputs, to musical tone generating circuit 7, new pitch data or octave data for octave alteration which corresponds to the pitch newly set by the octave changing operation, not immediately but upon elapse of the predetermined second delay time from the point of the alteration, based on a tone generation start instruction from timer 14-2.

Figures 3A, 3B, 3C:
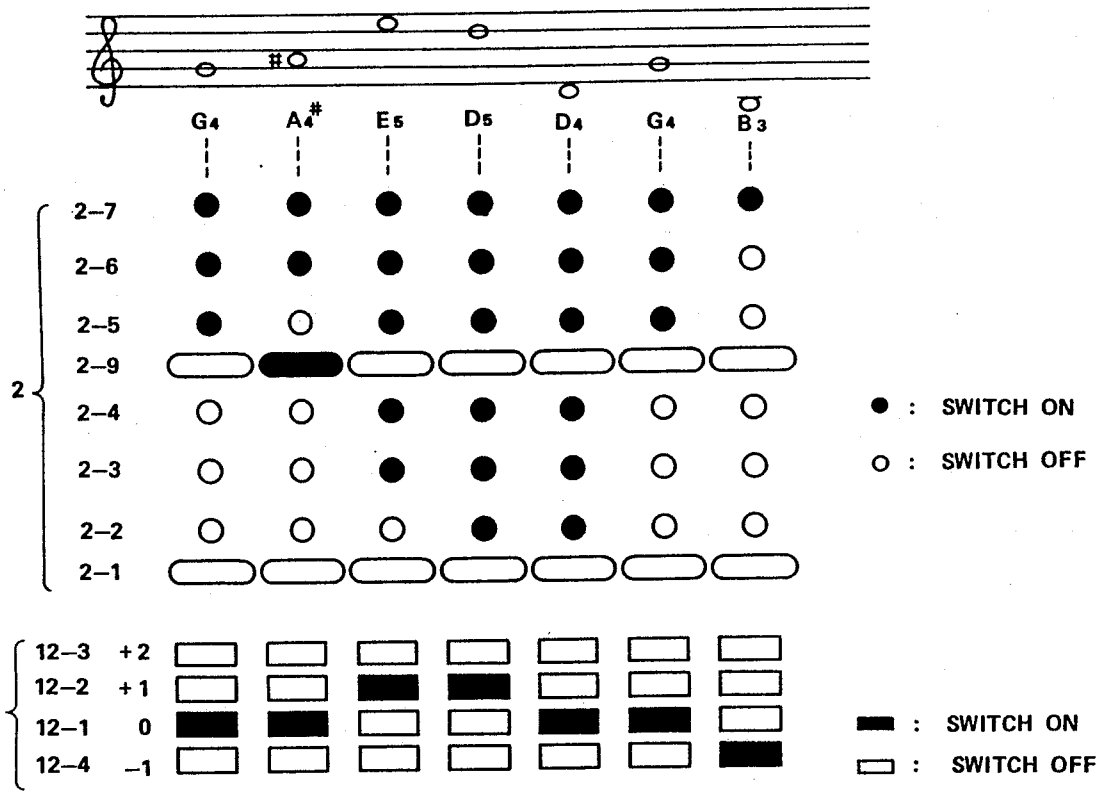
FIGS. 3*a*, 3*b*, and 3*c* are diagrams for explaining the fingering operation of pitch-setting switches.

FIGS. 3*a*, 3*b* and 3*c* illustrate the relation between the individual notes of a score on a staff and the fingering operation of pitch-setting switches 2 and the operation status of octave-changing switches 12 in the electronic wind instrument according to the first embodiment.

FIG. 3*b* illustrates the fingering operation pitch-setting switches 2 corresponding to the pitches of the individual notes $G_4$ to $B_3$ indicated on the staff shown in FIG. 3*a*, the black circles indicating a switch ON state and the white circles indicating a switch OFF state. FIG. 3*c* illustrates the operation of octave-changing switches 12 corresponding to the pitches of the individual notes $G_4$ to $B_3$ of the score shown in FIG. 3*a*, the black boxes indicating the octave-changing ON state and the white boxes indicating the octave-changing OFF state.

For instance, to set the pitch of the first note $G_4$ shown in FIG. 3*a* and then alter the pitch to that of the next note $A_4$#, the following operation will be executed.

First, ON operation of pitch-setting switches 2-5 to 2-7 is performed for $G_4$ with the left hand and octave-changing switch 2-1 is operated to be in the normal state with the left hand, thereby the pitch for $G_4$ is set. Then, with respect to $A_4$#, pitch-setting switch 2-5 is rendered OFF while keeping pitch-setting switches 2-6 and 2-7 in the ON state, and sharp switch 2-9 is rendered ON with the left hand. Octave-changing switch 12-1 is kept in the octave-changing state. Accordingly, the pitch of $A_4$# is set. To further alter the pitch to the pitch of the third note $E_5$ from that of $A_4$#, pitch-setting switch 2-5 is newly rendered ON and sharp switch 2-9 is rendered OFF with the left hand, and pitch-setting switches 2-4 and 2-3 are newly rendered ON with the right hand while switching octave-changing switch 12-1 to octave-changing switch 12-2 with the left hand. Accordingly, the pitch is altered to a pitch one higher by one octave. To alter the pitch of $D_5$ to that of $D_4$ or alter the pitch of $G_4$ to that of $B_3$, the presently-set octave-changing switch is switched to octave-changing switch 12-1 or 12-4.

Figure 4:
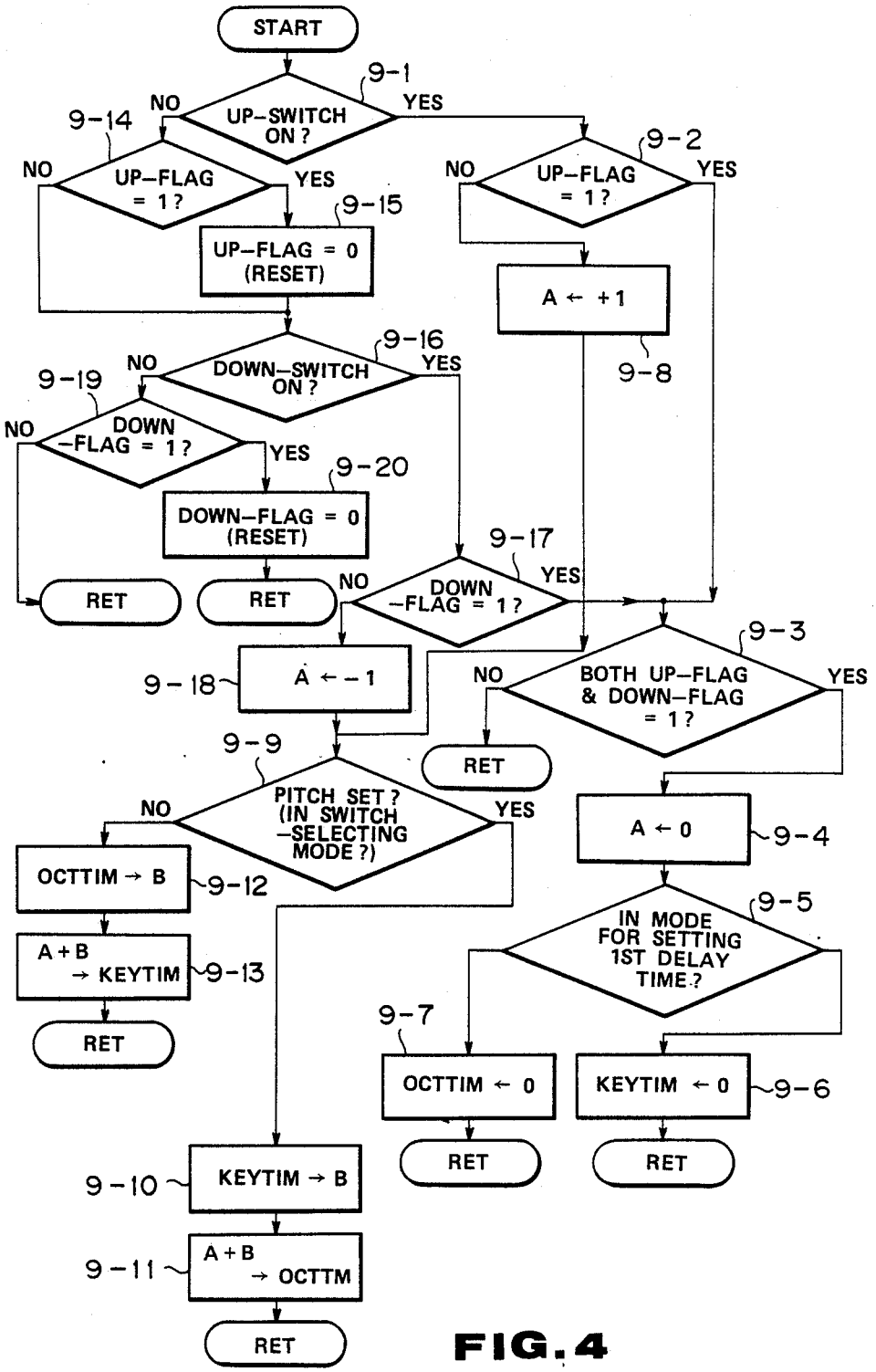
FIG. 4 is a flowchart for variably setting a delay time.

FIG. 4 is a flowchart for variably setting the aforementioned first and second delay times, and this flow starts upon occurrence of a timer interrupt with respect to the main routine (not shown) of the operation of CPU 6 or is repeatedly executed at a predetermined timing.

First, in step 9-1, it is determined whether or not UP switch 13-2 of delay time setting switches 13 is rendered ON, and if YES in this step, it is then determined in step 9-2 whether or not "1" is set in the up-flag. If YES in step 9-2, which means that UP switch 13-2 has already been rendered ON, it is determined in step 9-3 whether or not DOWN switch is simultaneously rendered ON. If it is negative (NO) in the last step, no new process needs to be executed so that the flow returns to the main routine. However, if it is YES in step 9-3, which means that the selected switch operation is for setting the delay time to the middle value, in step 9-4, data "0" representing the middle value is set in an A buffer that serves to store delay time setting data. In the subsequent step 9-5, it is determined whether or not delay time setting mode selecting switch 13-1 is set in the mode to select pitch-setting switches 2. If YES in this step, which means that the mode for variably setting the first delay time with respect to pitch-setting switches 2 is set, middle value data "0" is written in a pitch timer buffer KEYTIM in step 9-6 and the flow returns to the main routine. As a result, with the fingering operation of pitch-setting switches 2 being altered, the first delay time (time corresponding to the middle value data, e.g., 20 msec) is set to output new pitch data corresponding to the pitch newly set by the alteration to tone generating circuit 7 from timer 14-1 upon elapse of a predetermined delay time from the point of alteration.

If it is NO in step 9-5, which means that the mode is selected to variably set the second delay time with respect to octave-changing switches 12, the middle value data "0" is written in an octave timer buffer OCTTIM in step 9-7 and the flow then returns to the main routine. As a result, similarly, with the switching operation of octave-changing switches 12 being performed, the second delay time is set to output new octave alteration data corresponding to the pitch newly set by the switching operation to tone generating circuit 7 from timer 14-2 with a delay also corresponding to the middle value data from the point of alteration.

If it is NO in step 9-2, which means that UP switch 13-2 has been newly rendered ON to newly alter the set delay time, data "+1" for increasing the delay time by one step (e.g., 5 msec) is set in A buffer in step 9-8. The flow then advances to step 9-9 where it is determined whether or not delay time setting switch 13-1 is set in the mode to select pitch-setting switches 2. If YES in this step, which means that the mode is selected to variably set the first delay time to pitch-setting switches 2, the data of the first delay time previously stored in pitch timer buffer KEYTIM is transferred to a B buffer in step 9-10, and the result of the addition of this data and the data set in A buffer in step 4-8 (i.e., +1 in this case) is set in pitch timer buffer KEYTIM in step 9-11. The flow then returns to the main routines. Consequently, the new delay time has been set which is the first delay time increased by one step in association with the present ON operation of UP switch 13-2.

IF the decision is NO in step 9-9, it means that the mode is selected to variably set the second delay time to octave-changing switches 12, the data previously stored in octave timer buffer OCTTIM is transferred to B buffer in step 9-12, and the result of the addition of this data and the data (+1) previously set in A buffer in step 9-13 is set in octave timer buffer OCTTIM step 9-13. Accordingly, the new delay time has been set which is the second delay time increased by one step in association with the present ON operation of UP switch 13-2, and the flow then returns to the main routines. If the data in B buffer is already the maximum value (e.g., +10) or minimum value (e.g., −10) in step 9-12, the content of B buffer will not be altered.

If the decision in step 9-1 is NO, it means that UP switch 13-2 is not rendered ON, so that it is determined in step 9-14 whether or not the up-flag is "1." If YES in this step, "0" is set to the up-flag to reset it to thereby indicate that UP switch 13-2 is not in the ON state, and the flow then advances to step 9-16. If the decision in step 9-14 is NO, it is unnecessary to set the up-flag again and the flow advances to step 9-16 without re-setting the flag. In step 9-16, it is determined whether or not DOWN switch 13-3 is rendered ON. If YES in this step, it is determined in step 9-17 whether or not "1" is set to the down-flag. If the decision here is YES, it means that DOWN switch 13-3 has already rendered ON, the flow advances to the aforementioned step 9-3 and the above-described process will be executed. (Its description will be omitted here to avoid redundancy.) If the decision in step 9-17 is NO, it means that DOWN switch 13-3 is presently rendered ON and the delay time is newly set shorter. In the subsequent step 9-18, data (−1) for shortening the delay time by one step (e.g., by 5 msec) is set in A buffer, and the flow advances to step 9-9. Then, the above-described process is similarly carried out to set the shortened first and second delay times, and the flow returns to the main routine. If the decision in step 9-16 is NO, it means that neither UP switch 13-2 nor DOWN switch 13-3 is not rendered ON, so that it is determined in step 9-19 whether or not "1" is set to the down-flag. If YES in this step, "0" is set to the down-flag in step 9-20 to indicate that DOWN switch 13-3 is not rendered ON this time, and the flow returns to the main routine. If the decision in step 9-19 is NO, since no alteration process is required, the flow returns to the main routine without carrying out any alteration.

Figure 5:
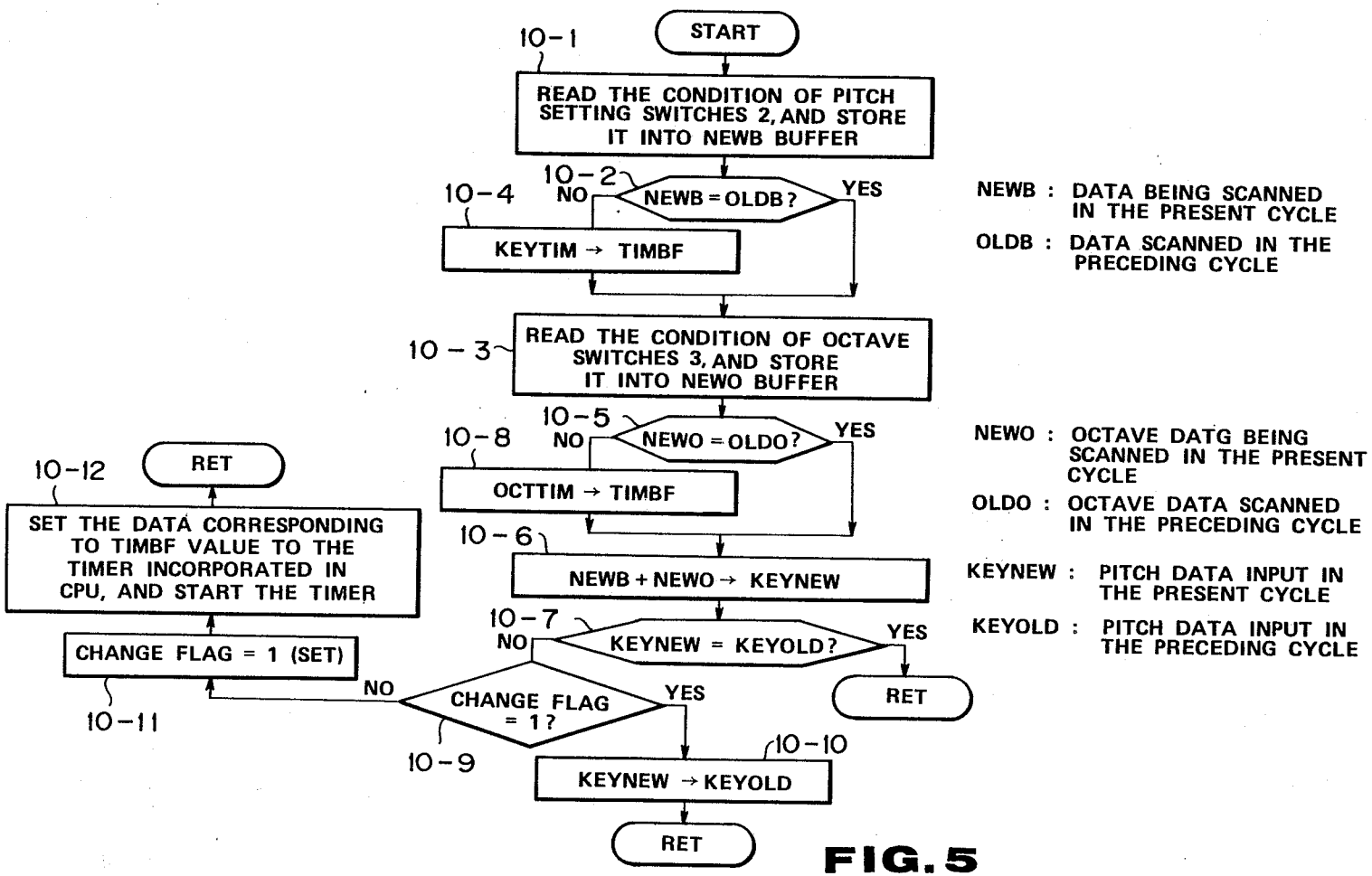
FIG. 5 is a flowchart for scanning the operation of pitch-setting switches and octave-changing switches.

FIG. 5 is a flowchart for scanning the operation of pitch-setting switches 2 and octave-changing switch 12 in the electronic wind instrument according to the first embodiment, and this flow is a subroutine that repeatedly executed at given intervals with respect to the flow of the main routine (not shown) of CPU 6.

First, in step 10-1, the operated ON/OFF status of pitch-setting switches 2 is scanned, and pitch data set by pitch-setting switches 2 is read out and stored in present pitch data buffer NEWB. In the subsequent step 10-2, it is determined whether or not the present pitch data coincides with the previously-acquired pitch data stored in previous pitch data buffer OLDB. IF YES in this step, it means that no change occurs in the operation of pitch-setting switches 2 for altering the pitch, so that the flow advances to step 10-3. If the decision in step 10-2 is NO, which means that some change has occurred in the operation of pitch-setting switches 2, so that the flow advances to step 10-4 where data corresponding to the first delay time set in advance in a pitch timer buffer KEYTIM is set in a time buffer TIMBF incorporated in CPU 6 to be ready for measuring the first delay time before the flow advances to step 10-3.

In step 10-3, the switching operation status of octave-changing switches 12 is scanned and the octave alteration data set by octave-changing switches 12 is read out and stored in a present octave alteration data buffer NEWO. In the next step 10-5, it is determined whether or not the present octave alteration data coincides with the previously acquired octave alteration data. If YES, the flow advances to step 10-6 where the pitch setting data acquired by the present scanning and stored in step 10-1 is added to the octave alteration data acquired by the present scanning and stored in step 10-3 and the resultant data is stored in present pitch data buffer KEYNEW and the flow advances to step 10-7. If the decision in step 10-5 is NO, the old data stored in octave timer buffer OCTTIM in step 10-8 is transferred to time buffer TIMBF and the flow advances to step 10-6. After executing step 10-6, the flow advances to step 10-7 where it is determined whether or not the content of present pitch data buffer KEYNEW coincides with the content of previous pitch data buffer KEYOLD, which is the pitch data acquired by the previous scanning. If YES, it means that no pitch alteration has occurred and it is unnecessary to output new pitch data, so that the flow returns to the main routine without further process. If the decision in step 10-7 is NO, it is necessary to output new pitch data so that the flow advances to step 10-9 where it is determined whether or not "1" is set to the pitch change flags in timers 14-1 and 14-2. If YES, it means that timers 14-1 and 14-2 are already in counting action, so that the new pitch data stored in present pitch data buffer KEYNEW is transferred to previous pitch data buffer KEYOLD in step 10-10, and the flow returns to the main routine. If the decision in step 10-9 is NO, it means that timers 14-1 and 14-2 have not started the counting action yet and it is necessary to output new pitch data, so that "1" is set to each pitch change flag in the subsequent step 10-11. In the subsequent step 10-12, the delay time setting data corresponding to the first and second delay times, which are set in advance in time buffer TIMBF, are respectively set to timers 14-1 and 14-2 incorporated in CPU 6, thereby starting the counting operation of the timers 14-1 and 14-2. The flow then returns to the main routine.

As described above, in the scan flow, scanning is executed to detect whether or not a change has occurred in the ON/OFF operation status of pitch-setting switches 2 or octave-changing switches 12 during the breath manipulation, and when such a change is detected, the counting operation of timers 14-1 and 14-2 are started which measure the elapse of the delay times for delaying, by set times, the output of pitch data to tone generating circuit 7 through CPU 6 from pitch-setting switches 2 or octave-changing switches 12.

Figure 6:
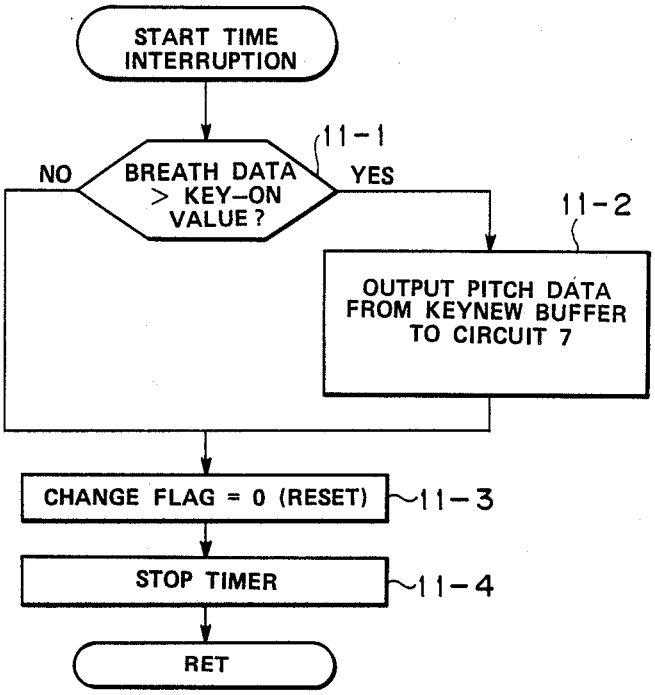
FIG. 6 is a flowchart for a pitch alteration process.

FIG. 6 is a flowchart for a pitch alteration process, and this flow causes a timer interrupt to the main routine.

First, in step 11-1 it is determined whether or not the value of digital breath data based on the breath data detected by breath sensor 1 through the blowing has exceeded a predetermined key-ON set value that indicates the start of tone generation. If YES, it is in key-ON state or a musical tone is being generated, the data stored in present pitch data buffer NEWB is sent out to tone generating circuit 7 to generate a musical tone with the pitch corresponding to this pitch data in step 11-2.

In the subsequent step 11-3, the pitch change flags of timers 14-1 and 14-2 are reset to have a value of "0" to stop the counting action of these timers to be ready for the next alteration in the operation status of pitch-setting switches 2 and octave-changing switches 12. The flow then returns to the main routine, thereby completing the interrupt operation.

If the decision in step 11-1 is NO, it means that the value of digital breath data has not yet reached the key-ON set value and it is not the time to instruct the start of tone generation, i.e., it is in a key-OFF state. In this case, the flow advances to step 11-3 and thereafter, the same processes as executed in the case of the key-ON state are performed before returning to the main routine.

As should be understood from the above, in this flow, the pitch data altered by the fingering operation of pitch-setting switches 2 or the switching operation of octave-changing switches is supplied to tone generating circuit 7 when the digital breath data becomes equal to or greater than the key-ON set value.

In the above embodiment, timers 14-1 and 14-2 are provided in CPU 6 exclusively for counting the delay times. Instead of using these timers 14-1 and 14-2, the number of the repetitive operation of the main routine may be counted to thereby count the delay times. In this case, with the main routine being repeatedly executed at a 4 msec tempo, the value of time buffer TIMBF needs to be 5 or 9, for example.

Effect of the First Embodiment

As described above, with the electronic wind instrument according to the first embodiment, when the fingering operation of pitch-setting switches 2 (2-1 to 2-8) is changed during the performance by the breath manipulation, new pitch data corresponding to the altered state is supplied to tone generating circuit 7, not immediately, but upon elapse of the predetermined first delay time (which is set in consideration of the time required to complete at least the proper and stable fingering operation) based on the tone generation start instruction from timer 14-1, and a musical tone with the new pitch corresponding to the altered fingering operation is generated from tone generating circuit 7 based on the pitch data. Similarly, when the switching operation of octave-changing switches 12 is altered, new pitch data corresponding to the alteration is supplied to tone generating circuit 7, not immediately, but upon elapse of the predetermined second delay time (which is set in consideration of the time required to complete at least the proper and stable fingering operation, as per the first delay time involved in the operation change of pitch-setting switches 2) based on the tone generation start instruction from timer 14-2. Therefore, it is possible to prevent a musical tone with the undesired pitch from being generated even in a transient status where the fingering operation of pitch-setting switches 2 and the switching operation of octave-changing switches 12 are not stable at predetermined operation statuses, that is, when the operational timings of a plurality of pitch-setting switches 2-1 to 2-7 involving a plurality of fingers are not synchronized such that the individual pitch-setting switches 2-1 to 2-7 are operated with some time delays. It is also possible to prevent generation of a musical tone with the undesired pitch even when the operational timings of pitch-setting switches 2-1 to 2-7 are not synchronized with the switching operation timings of the individual octave-changing switches 12-1 to 12-4. Further, since, unlike the conventional instrument, no tone stopping circuit is provided, pitch alteration can be executed in a smooth continuous tone-generation state without stopping the tone generation even temporarily, so that a music can be played in a natural tone-generation state.

Furthermore, the present instrument is designed such that the first and second delay times for delaying the output of pitch data by predetermined times can be arbitrarily set by means of timers 14-1 and 14-2 by a player in accordance with his or her playing skill. Accordingly, the delay times can be set in accordance with the level of the fingering operation and switching operation by the player, thus providing a significant effect and making the present instrument easy to play.

SECOND EMBODIMENT

Arrangement and Operation of the Second Embodiment

The electronic wind instrument according to the second embodiment has the same general outline and the same electronic circuit arrangement as the instrument of the first embodiment, so that their detailed description will be omitted below.

Figure 7:
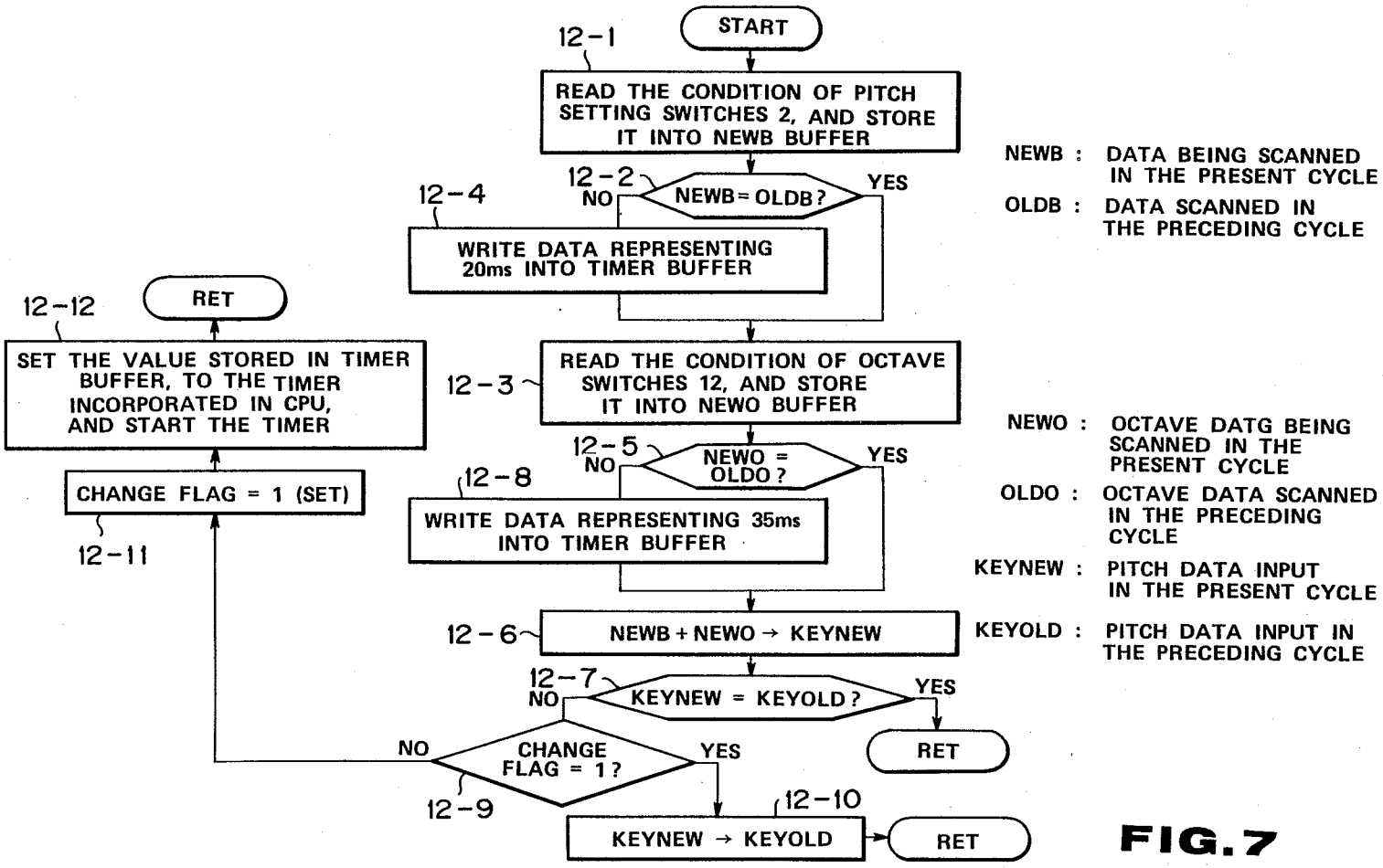
FIG. 7 is a flowchart for scanning the operation of pitch-setting switches and octave-changing switches in an electronic wind instrument according to the second embodiment of this invention.

FIG. 7 is a flowchart for scanning the operation of the pitch-setting switches and octave-changing switches, and this is a subroutine that is repeatedly executed at a given timing with respect to the flow of the main routine (not shown) of CPU 6.

First, in step 12-1, the ON/OFF operation status of pitch-setting switches 2 is scanned and pitch data acquired by this scanning is stored in present pitch data buffer NEWB. In the next step 12-2, it is determined whether or not the present pitch data coincides with the content (previously acquired pitch data) of previous pitch data buffer OLDB. If YES, it means that no change has occurred in the operation status of pitch-setting switches 2, so that the flow advances directly to step 12-3. If the decision in step 12-2 is NO, it means the occurrence of an operational change in these switches, so that the flow advances to step 12-4 where the first delay time (a relatively short delay time of 20 msec in this case since the fingering operation of pitch-setting switches 2 is performed with other fingers than the thumb and is thus relatively easy), which has been set in advance in pitch timer buffer KEYTIM through delay time setting switches 13 (see FIGS. 1C and 2), is transferred to time buffer TIMB built on CPU 6. The flow then advances to step 12-3.

In step 12-3, the switching operation status of octave-changing switches 12 is scanned and octave-changing data acquired by this scanning is stored in present octave alteration data buffer NEWO. In the subsequent step 12-5, it is determined whether or not the present octave alteration data coincides with the previously acquired octave alteration data. If YES, the flow advances to step 12-6 where the result of addition of the pitch set data acquired by the present scanning and stored in step 12-1 and the octave alteration data acquired by the present scanning and stored in step 12-3 is stored in present pitch data buffer KEYNEW before the flow advances to step 12-7. If the decision in step 12-5 is NO, the flow advances to step 12-8 where the second delay time (a relatively long delay time of 35 msec in this case since the switching operation of octave-changing switches 12 is performed with the thumb and is thus relatively easier as compared with the fingering operation of pitch-setting switches 2), which has been previously set in octave timer buffer OCTTIM through delay time setting switches 13 (see FIG. 1C and 2), is transferred to time buffer TIMB. The flow then advances to step 12-6 followed by step 12-7 were it is determined whether or not the content of present pitch data buffer KEYNEW coincides with the content of previous pitch data buffer KEYOLD. If YES in step 12-7, no pitch alteration is made and it is unnecessary to output new pitch data, so that the flow returns to the main routine without further process. If the decision in step 12-7 is NO, however, it is necessary to output new pitch data so that the flow advances to step 12-9 where it is determined whether or not "1" is set to the pitch change flags in timers 14-1 and 14-2. If YES, timers 14-1 and 14-2 are in a counting operation, and the flow advances to step 12-10 where the pitch data stored in present pitch data buffer KEYNEW is transferred to previous pitch data buffer KEYOLD to be ready for the next scanning. The flow then return to the main routine. If the decision in step 12-9 is NO, timers 14-1 and 14-2 have not started the time counting yet, and a new tone is to be generated, so that "1" is set to the pitch change flags in these timers in step 12-11. In the subsequent step 12-12, data corresponding to the first and second delay times set in advance in time buffer TIMBF ar respectively set to built-in timers 14-1 and 14-2 of CPU 6 to start the counting operation of these timers in order to delay the output of pitch data by a predetermined time at the time of pitch alteration. The flow then returns to the main routine.

Referring to FIGS. 3*a*, 3*b*, and 3*c*, a description will be given of the statuses of the fingering operation of pitch-setting switches 2 and the switching operation of octave-changing switches 12 in the electronic wind instrument according to the second embodiment.

When the playing of the first note $G_4$ is changed to the playing of the next note $A_4$#, since no alteration is made to the switching operation of octave-changing switches 12, the musical tone of $A_4$# is generated with a delay of the first delay time (e.g., 20 msec) that is set in advance in association with a change in the operation of pitch-setting switches 2. With regard to alteration to the pitch of $E_5$ from that of $A_4$#, since a change occurs both in pitch-setting switches 2 and octave-changing switches 12, the musical tone of $E_5$ is generated with a delay of the second delay time (e.g., 35 msec) that is set longer than the first delay time in advance. With regard to alteration to $D_5$ from $E_5$, since no change also occurs in the operation octave-changing switches 12, the generation of the musical tone of $D_5$ is delayed by the first delay time (20 msec). With regard to alteration to $D_4$ from $D_5$, since a change occurs in the operation of octave-changing switches 12 though no change occurs in the operation of pitch-setting switches 2, the generation of the musical tone of $D_4$ is delayed by the second delay time (35 msec). Similarly, the intended musical tone will be delayed by the first delay time for alteration to $G_4$ from $D_4$ and by the second delay time for alteration to $B_3$ from $G_4$. In other words, according to the second embodiment, when a change occurs in the switching operation of octave-changing switches 12, the start of the output of pitch data is delayed by the second delay time set longer than the first delay time that has been set to pitch-setting switches 2.

Since the pitch alteration operation of CPU 6 in the second embodiment is the same as that involved in the first embodiment (see FIG. 6), its description will be omitted below.

Although timers 14-1 and 14-2 are incorporated in CPU 6 to count the individual delay times according to the second embodiment, this design may be modified to count the number of the main routine executed.

Effect of the Second Embodiment

According to the second embodiment, unlike in the first embodiment, the second delay time (35 msec in this embodiment) for the switching operation of octave-changing switches 12 is set longer than the first delay time (20 msec in this embodiment) for the fingering operation of pitch-setting switches 2-1 to 2-8, so that the output timing of pitch data can be delayed by a time sufficient to complete the switching operation of octave-changing switches 12 which is required a higher skill than the fingering operation of pitch-setting switches 2. It is therefore possible to prevent temporary generation of musical tone at the undesired pitch at the time the switching operation of octave-changing switches 12 is executed. This eliminates the need to make the first delay time for the fingering operation of pitch-setting switches 2 coincide with the second delay time for octave-changing switches 12 and can thus permit the first delay time to be set sufficiently short. Even a quick trill is performed by the pitch setting operation through pitch-setting switches 2, therefore, it is possible to prevent the output of the pitch data after a change in the fingering operation from being delayed more than necessary.

When a change occurs both in the operations of pitch-setting switches 2 and octave-changing switches 12, the delay time may be set longer, e.g., 45 msec, and when a change occurs only in the operation of octave-changing switches 12, the delay time may be set to 35 msec.

Modification

Unlike the first and second embodiments, tone generating circuit 7 and tone outputting device 10 may be separately provided as external units in such a way that these units can be electrically coupled to wind instrument body 101.

Further, the outline of the present electronic wind instrument is not restricted to be that of a saxophone, but may take other forms, such as the outline of a clarinet.

What is claimed is:

1. An electronic musical instrument, comprising:

a plurality of pitch designation means for designating a pitch of a musical tone to be generated according to combined pitch-setting operations by a player;

air flow sensor means for detecting an air flow state induced by a player and for producing a corresponding air flow sensing signal;

tone generation instructing means for instructing generation of a musical tone at a pitch set by said plurality of pitch designation means based on said air flow sense signal produced by said air flow sensor means;

change timing detection means responsive to a change in a combined pitch-setting operation of said plurality of pitch designation means, for detecting a timing of said change; and tone control means responsive to said change timing detection means detecting a change in said combined pitch-setting operation, for controlling generation of a musical tone at a new pitch newly set by said change in said combined pitch-setting operation, upon elapse of a predetermined time from said detected timing of said change.

2. The instrument according to claim 1, wherein said tone control means includes means for, upon detection of said timing of said change by said change timing detection means, generating a musical tone at a pitch according to pitch data corresponding to a pitch set prior to a change in said combined pitch setting operation until a predetermined time elapses from said detected timing of said change, and for generating a musical tone at a pitch according to pitch data corresponding to a pitch newly set after said change in said combined pitch setting operation after said combined predetermined time elapses.

3. The instrument according to claim 1, wherein said tone control means includes counter means for, upon detection of said timing of said change by said change timing detection means, starting a count operation and permitting output of pitch data corresponding to a pitch newly set by said pitch designation means when a predetermined count value is reached.

4. The instrument according to claim 1, further comprising tone generating means for, when a combined pitch-setting operation of said plurality of pitch designation means is executed, generating a musical tone at a pitch set by said pitch-setting operation.

5. The instrument according to claim 1, wherein said plurality of pitch designation means include:

a plurality of first pitch designation means for setting a pitch of a musical tone to be generated by a unit of a half tone or a whole tone; and at least one second pitch designation means for altering said pitch set by said first pitch designation means by a unit of an octave and setting said altered pitch;

wherein said change timing detection means includes first and second change timing detectors for independently detecting changes in pitch setting operations of said first and second pitch designation means; and wherein said tone control means includes pitch data output means for, when timings of said changes are detected by said first and second change timing detectors, outputting pitch data corresponding to new pitches set after said changes in said pitch setting operations occur, upon elapse of predetermined first and second times from said timings of said changes, respectively.

6. The instrument according to claim 5, wherein said pitch data output means includes time setting means for arbitrarily setting said first and second times.

7. The instrument according to claim 5, wherein said first and second times have a same duration.

8. The instrument according to claim 5, wherein said duration of said second time is longer than a duration of said first time.

9. The instrument according to claim 1, further comprising elapse time setting means capable of variably setting a duration of said predetermined time to an arbitrary value.

10. An electronic musical instrument, comprising:

air flow sensor means for detecting an air flow induced by a player and for producing a corresponding air flow sense signal;

tone generation instructing means for instructing a start of generation of a musical tone at a pitch set by said plurality of pitch designation means when said air flow sense signal produced by said air flow sensor means reaches a predetermined level or is above said predetermined level;

tone generation keeping means for controlling continuous generation of a musical tone at said pitch set by said plurality of pitch designation means after said tone generation instructing means instructs said generation of said musical tone, and until said air flow sense signal reaches a predetermined level or is below said predetermined level;

change timing detection means for detecting a timing of a change in a combined pitch setting operation of said plurality of pitch designation means; and pitch altering means responsive to said change timing detection means detecting a timing of a change in said combined pitch setting operation while tone generation continues based on said air flow sense signal from said air flow sensor means, for outputting pitch data corresponding to a pitch newly set by said change in said combined pitch setting operation upon elapse of a predetermined time from said timing of said change in said pitch setting operation, and for altering an old pitch set at said timing of said change in said pitch setting operation to a new pitch according to said newly outputted new pitch data.

11. The instrument according to claim 10, wherein said pitch altering means includes means for, upon detection of a timing of a change in said pitch setting operation by said change timing detection means, altering a pitch to a pitch newly set upon elapse of a predetermined time from said timing of said change.

* * * * *